US006464624B2

(12) United States Patent
Pages

(10) Patent No.: US 6,464,624 B2
(45) Date of Patent: Oct. 15, 2002

(54) BLOOD PROCESSING METHOD AND APPARATUS USING A CENTRIFUGATION BOWL WITH FILTER CORE

(75) Inventor: Etienne Pages, Segny (FR)

(73) Assignee: Haemonetics Corporation, Braintree, MA (US)

( * ) Notice: Subject to any disclaimer, the term of this patent is extended or adjusted under 35 U.S.C. 154(b) by 0 days.

(21) Appl. No.: 09/879,550

(22) Filed: Jun. 12, 2001

(65) Prior Publication Data

US 2002/0032112 A1 Mar. 14, 2002

Related U.S. Application Data

(63) Continuation of application No. 09/325,253, filed on Jun. 3, 1999, now abandoned.

(51) Int. Cl.[7] ..... B04B 7/16
(52) U.S. Cl. ..... 494/36; 494/37; 494/41
(58) Field of Search ..... 494/10, 36, 37, 494/41, 43, 44, 67, 81; 210/360.1, 380.1, 781, 782

(56) References Cited

U.S. PATENT DOCUMENTS

| | | | | |
|---|---|---|---|---|
| 1,025,059 | A | | 4/1912 | Hatton et al. |
| 1,611,725 | A | * | 12/1926 | Degerth et al. |
| 2,087,778 | A | * | 7/1937 | Nelin |
| 2,750,107 | A | | 6/1956 | More |
| 2,792,172 | A | | 5/1957 | Tait |
| 3,145,713 | A | * | 8/1964 | Latham, Jr. |
| 3,409,213 | A | * | 11/1968 | Latham, Jr. |
| 3,565,330 | A | * | 2/1971 | Latham, Jr. |
| 3,655,058 | A | | 4/1972 | Novak |
| 3,774,840 | A | | 11/1973 | Boatright |
| 4,014,497 | A | | 3/1977 | Spiewok et al. |
| 4,040,965 | A | | 8/1977 | Kohlheb |

(List continued on next page.)

FOREIGN PATENT DOCUMENTS

| | | | | |
|---|---|---|---|---|
| EP | 257755 | * | 3/1988 | 494/41 |
| EP | 619145 | * | 10/1994 | 494/41 |
| EP | 664159 | * | 7/1995 | 494/41 |
| EP | 799645 | * | 10/1997 | 494/41 |
| EP | 1057534 | * | 12/2000 | 494/41 |
| JP | 59-6952 | * | 1/1984 | |
| JP | 59-69166 | * | 4/1984 | 494/41 |
| JP | 7-75746 | * | 3/1995 | 494/41 |
| JP | 9-192215 | * | 7/1997 | 494/41 |
| SU | 660718 | * | 5/1979 | 494/41 |
| SU | 762982 | * | 9/1980 | 494/41 |
| SU | 1146098 | * | 3/1985 | 494/41 |
| WO | 90/07383 | * | 7/1990 | 494/41 |
| WO | 94/06535 | * | 3/1994 | |

*Primary Examiner*—Charles E. Cooley
(74) *Attorney, Agent, or Firm*—Bromberg & Sunstein LLP

(57) ABSTRACT

The invention is directed to blood processing method and apparatus utilizing a centrifugation bowl with a filter core disposed within the bowl. The centrifugation bowl includes a rotating bowl body defining an enclosed separation chamber. A generally cylindrical filter core is disposed inside the separation chamber. The filter core includes a filter membrane that is sized to block at least white blood cells, but to allow plasma to pass through. The filter core is generally arranged within the separation chamber such that plasma is forced to pass through the filter core before being removed from the centrifugation bowl. The addition of the filter core provides an efficient, low-cost method for recovering a "purer" plasma fraction from a donor.

22 Claims, 6 Drawing Sheets

U.S. PATENT DOCUMENTS 4,086,924 A 5/1978 Latham, Jr.
4,140,268 A * 2/1979 Lacour
4,300,717 A * 11/1981 Latham, Jr.
4,425,114 A 1/1984 Schoendorfer et al.
4,466,888 A 8/1984 Verkaart
4,534,863 A 8/1985 Bacon et al.
4,684,361 A * 8/1987 Feldman et al.
4,692,136 A * 9/1987 Feldman et al.
4,713,176 A 12/1987 Schoendorfer et al.
4,740,202 A 4/1988 Stacey et al.
4,740,313 A 4/1988 Schoendorfer et al.
4,755,300 A 7/1988 Fischel et al.
4,767,396 A * 8/1988 Powers
4,795,419 A * 1/1989 Yawn et al.
4,795,448 A 1/1989 Stacey et al.
4,806,247 A 2/1989 Schoendorfer et al.
4,808,307 A 2/1989 Fischel et al.
4,869,812 A 9/1989 Schoendorfer et al.
4,871,462 A 10/1989 Fischel et al.
4,876,013 A 10/1989 Shmidt et al.
4,889,524 A 12/1989 Fell et al.
4,943,273 A 7/1990 Pages
4,983,158 A 1/1991 Headley
4,994,188 A 2/1991 Prince
5,045,048 A * 9/1991 Kaleskas et al.
5,100,372 A 3/1992 Headley
5,100,564 A 3/1992 Pall et al.
5,194,145 A 3/1993 Schoendorfer
5,254,248 A 10/1993 Nakamura
5,387,174 A * 2/1995 Rochat
5,403,272 A 4/1995 Deniega et al.
5,405,308 A 4/1995 Headley et al.
5,431,814 A * 7/1995 Jorgensen
5,462,667 A * 10/1995 Wollinsky et al.
5,494,592 A 2/1996 Latham, Jr. et al.
5,514,070 A 5/1996 Pages
5,551,941 A * 9/1996 Howell
5,585,007 A * 12/1996 Antanavich et al.
5,607,579 A 3/1997 Latham, Jr. et al.
5,649,903 A 7/1997 Deniega et al.
5,656,163 A 8/1997 Brown
5,733,446 A 3/1998 Holm
5,738,792 A 4/1998 Schoendorfer
5,762,791 A 6/1998 Deniega et al.
5,783,085 A 7/1998 Fischel
5,792,351 A 8/1998 Wehrle et al.
5,882,289 A * 3/1999 Sakota et al.
5,919,125 A * 7/1999 Berch
2001/0027156 A1 * 10/2001 Egozy et al.

* cited by examiner

BLOOD PROCESSING METHOD AND APPARATUS USING A CENTRIFUGATION BOWL WITH FILTER CORE

RELATED APPLICATION

This application is a continuation of application Ser. No. 09/325,253, filed Jun. 3, 1999, now abandoned.

FIELD OF THE INVENTION

The invention relates to blood processing apparatus having centrifugation bowls for separating blood and other similar fluids. More specifically, the present invention relates to such apparatus with a centrifugation bowl having a rotating filter core for use in recovering a plasma fraction from whole blood.

BACKGROUND OF THE INVENTION

Human blood predominantly includes three types of specialized cells (i.e., red blood cells, white blood cells, and platelets) that are suspended in a complex aqueous solution of proteins and other chemicals called plasma. Although in the past blood transfusions have used whole blood, the current trend is to collect and transfuse only those blood components of fractions required by a particular patient. This approach preserves the available blood supply and in many cases is better for the patient, since the patient is not exposed to unnecessary blood components, especially white blood cells, which can transmit pathogens. Two of the more common blood fractions used in transfusions are red blood cells and plasma. Plasma transfusions, in particular, are often used to replenish depleted coagulation factors. Indeed, in the United States alone, approximately 2 million plasma units are transfused each year. Collected plasma is also pooled for fractionation into its constituent components, including proteins, such as Factor VIII, albumin, immune serum globulin, etc.

Individual blood components, including plasma, can be obtained from units of previously collected whole blood through "bag" centrifugation. With this method, a unit of anti-coagulated whole blood contained in a plastic bag is placed into a lab centrifuge and spun at very high speed, subjecting the blood to many times the force of gravity. This causes the various blood components to separate into layers according to their densities. In particular, the more dense components, such as red blood cells, separate from the less dense components, such as white blood cells and plasma. Each of the blood components may then be expressed from the bag and individually collected.

U.S. Pat. No. 4,871,462 discloses another method for separating blood. In particular, a filter includes a stationary cylindrical container that houses a rotatable, cylindrical filter membrane. The container and the membrane are configured so as to define only a narrow gap between the side wall of the container and the filter membrane. Blood is then introduced into this narrow gap. Rotation of the inner filter membrane at sufficient speed generates what are known as Taylor vortices in the fluid. The presence of Taylor vortices basically causes shear forces that drive plasma through the membrane and sweep red blood cells away.

Specific blood components may also be obtained through a process called apheresis in which whole blood is transported directly from the donor to a blood processing machine that includes an enclosed, rotating centrifuge bowl for separation of the blood. With this method, only the desired blood component is collected. The remaining components are returned directly to the donor, often allowing greater volumes of the desired component to be collected. For example, with plasmapheresis, whole blood from the donor is transported to the bowl where it is separated into its constituent components. The plasma is then removed from the bowl and transported to a separate collection bag, while the other components (e.g., red blood cells and white blood cells) are returned directly to the donor.

FIG. 1 is a block diagram of a plasmapheresis system 100 with an added filtration step. The system 100 includes a disposable harness 102 that is loaded onto a blood processing machine 104. The harness 102 includes a phlebotomy needle 106 for withdrawing blood from a donor's arm 108, a container of anti-coagulant solution 110, a temporary red blood cell (RBC) storage bag 112, a centrifugation bowl 114, a primary plasma collection bag 116 and a final plasma collection bag 118. An inlet line 120 couples the phlebotomy needle 106 to an inlet port 122 of the bowl 114, and an outlet line 124 couples an outlet port 126 of the bowl 114 to the primary plasma collection bag 116. The blood processing machine 104 includes a controller 130, a motor 132, a centrifuge chuck 134, and two peristaltic pumps 136 and 138. The controller 130 is operably coupled to the two pumps 136 and 138, and to the motor 132, which, in turn, drives the chuck 134.

In operation, the inlet line 120 is fed through the first peristaltic pump 136 and a feed line 140 from the anti-coagulant 110, which is coupled to the inlet line 120, is fed through the second peristaltic pump 138. The centrifugation bowl 114 is also inserted into the chuck 134. The phlebotomy needle 106 is then inserted into the donor's arm 108 and the controller 130 activates the peristaltic pumps 136, 138, thereby mixing anti-coagulant with whole blood from the donor, and transporting anti-coagulated whole blood through inlet line 120 and into the centrifugation bowl 114. Controller 130 also activates the motor 132 to rotates the bowl 114 via the chuck 134 at high speed. Rotation of the bowl 114 causes the whole blood to separate into discrete layers by density. In particular, the denser red blood cells accumulate at the periphery of the bowl 114 while the less dense plasma forms an annular ring-shaped layer inside of the red blood cells. The plasma is then forced through an effluent port (not shown) of the bowl 114 and is discharged from the bowl's outlet port 126. From here, the plasma is transported by the outlet line 124 to the primary plasma collection bag 116.

When all the plasma has been removed and the bowl 114 is full of RBCs, it is typically stopped and first pump 136 is reversed to transport the RBCs from the bowl 114 to the temporary RBC collection bag 112. Once the bowl 114 is emptied, the collection and separation of whole blood from the donor is resumed. At the end of the process, the RBCs in the bowl 114 and in the temporary RBC collection bag 112 are returned to the donor through the phlebotomy needle 106. The primary plasma collection bag 116, which is now full of plasma, may be removed from the harness 102 and shipped to a blood bank or hospital for subsequent transfusion.

Despite the system's generally high separation efficiency, the collected plasma can nonetheless contain some residual blood cells. For example, in a disposable harness utilizing a blow-molded centrifuge bowl from Haemonetics Corporation, the collected plasma typically contains from 0.1 to 30 white blood cells and from 5,000 to 50,000 platelets per micro-liter. This is due, at least in part, to the 8000 rpm rotational limit of the bowl 114 and the need to keep the bowl's filling rate in excess of 60 milliliters per minute (ml/min.) to minimize the collection time, causing slight re-mixing of blood components within the bowl. Furthermore, many countries continue to reduce the permissible level of white blood cells and other residual cells that may be present in their supply of blood components.

Discussion of System Not Found in the Prior Art

It has been suggested to install one or more filters, such as filter 142, to remove residual cells from the collected plasma in a manner similar to the filtration of collected platelets. Filter 142 may be disposed in a secondary outlet line 144 that couples the primary and final plasma collection bags 116, 118 together. After plasma has been collected in the primary plasma bag 116, a check valve (not shown) may be opened allowing plasma to flow through the secondary outlet line 144, the filter 142, and into the final plasma collection bag 118.

Although it may produce a "purer" plasma product, the disposable plasmapheresis harness including a separate filter element is disadvantageous for several reasons. In particular, the addition of a filter and another plasma collection bag increase the cost and complexity of the harness. Accordingly, an alternative system that can efficiently produce a "purer" plasma fraction at relatively low cost is desired.

SUMMARY OF THE INVENTION

Briefly, the present invention is directed to a centrifugation bowl with a rotating filter core disposed within the bowl. In particular, the centrifugation bowl includes a rotating bowl body defining an enclosed separation chamber. A stationary header assembly that includes an inlet port for receiving whole blood and an outlet port from which a blood component may be withdrawn is mounted on top of the bowl body through a rotating seal. The inlet port is in fluid communication with a feed tube that extends into the separation chamber. The outlet port is in fluid communication with an effluent tube disposed within the separation chamber of the bowl body. The effluent tube includes an entryway at a first radial position relative to a central, rotating axis of the bowl. A generally cylindrical filter core is disposed inside the separation chamber and mounted for rotation with the bowl body. The filter core is sized to block one or more residual cells, but to allow plasma to pass through. The filter core is generally arranged at a second radial position that is slightly outboard of the first radial position that defines the entryway to the effluent tube.

In operation, the bowl is rotated at high speed by a centrifuge chuck. Anti-coagulated whole blood is delivered to the inlet port, flows through the feed tube and is delivered to the separation chamber of the bowl body. Due to the centrifugal forces generated within the separation chamber, the whole blood is separated into its discrete components. In particular, the denser red blood cells form a first layer against the periphery of the bowl body. Plasma, which is less dense than red blood cells, forms an annular-shaped second layer inside of the first layer of red blood cells. As additional whole blood is delivered to the separation chamber, the annular-shaped plasma layer closes in on and eventually contacts the rotating filter core. Plasma passes through the filtering core, enters the entryway of the effluent tube and is withdrawn from the bowl through the outlet port. Any residual cells contained in the plasma layer are trapped on the outer surface of the filter core and thus cannot reach the entryway of the effluent tube, which is inside of the filter core relative to the axis of rotation. Accordingly, the plasma extracted from the centrifugation bowl of the present invention is generally free of residual cells, eliminating the need for any downstream filter elements.

When all of the plasma has been extracted from the bowl, leaving primarily a volume of red blood cells in the separation chamber, the bowl is stopped. In the absence of the centrifugal forces, the red blood cells simply collect in the bottom of the bowl. To prevent the red blood cells from contacting the inner surface of the filter core, a solid skirt extends upwardly from the bottom of the filter core. The red blood cells may be withdrawn from the stopped bowl through the feed tube and the "inlet" port. With the red blood cells evacuated from the bowl, the bowl may be rotated again. Subsequent rotation of the bowl causes any residual cells that might have adhered to the outer surface of the filter core during the filter process to be flung off of the core, essentially "cleaning" the filter core. Thus, the centrifugation bowl is ready for any subsequent blood separation cycles.

BRIEF DESCRIPTION OF THE DRAWINGS

The invention description below refers to the accompanying drawings, of which.

DETAILED DESCRIPTION OF AN ILLUSTRATIVE EMBODIMENT

Figure 1:
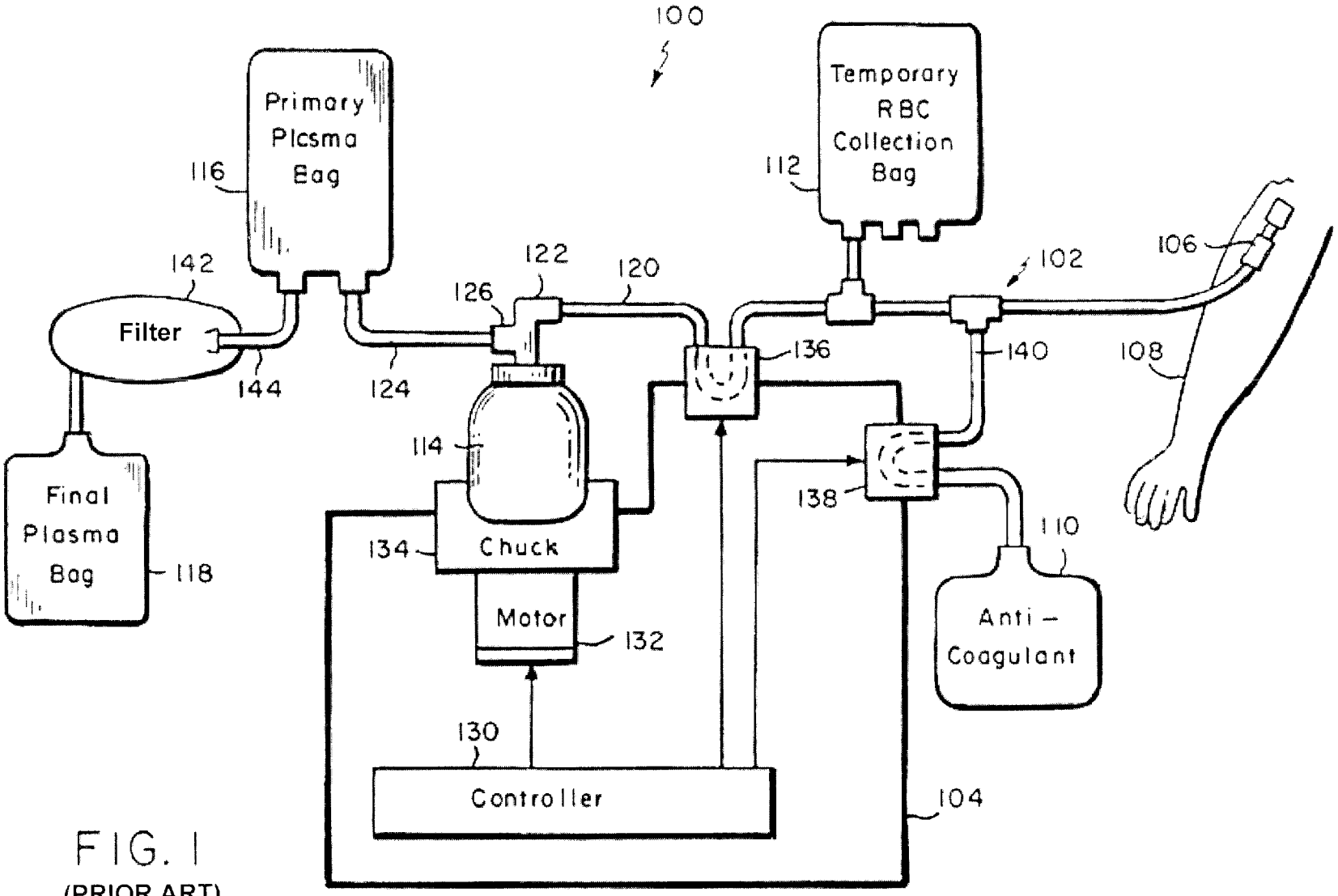
FIG. 1 (PRIOR ART)
FIG. 1, previously discussed, is a block diagram of a prior art plasmapheresis system.
Figure 2:
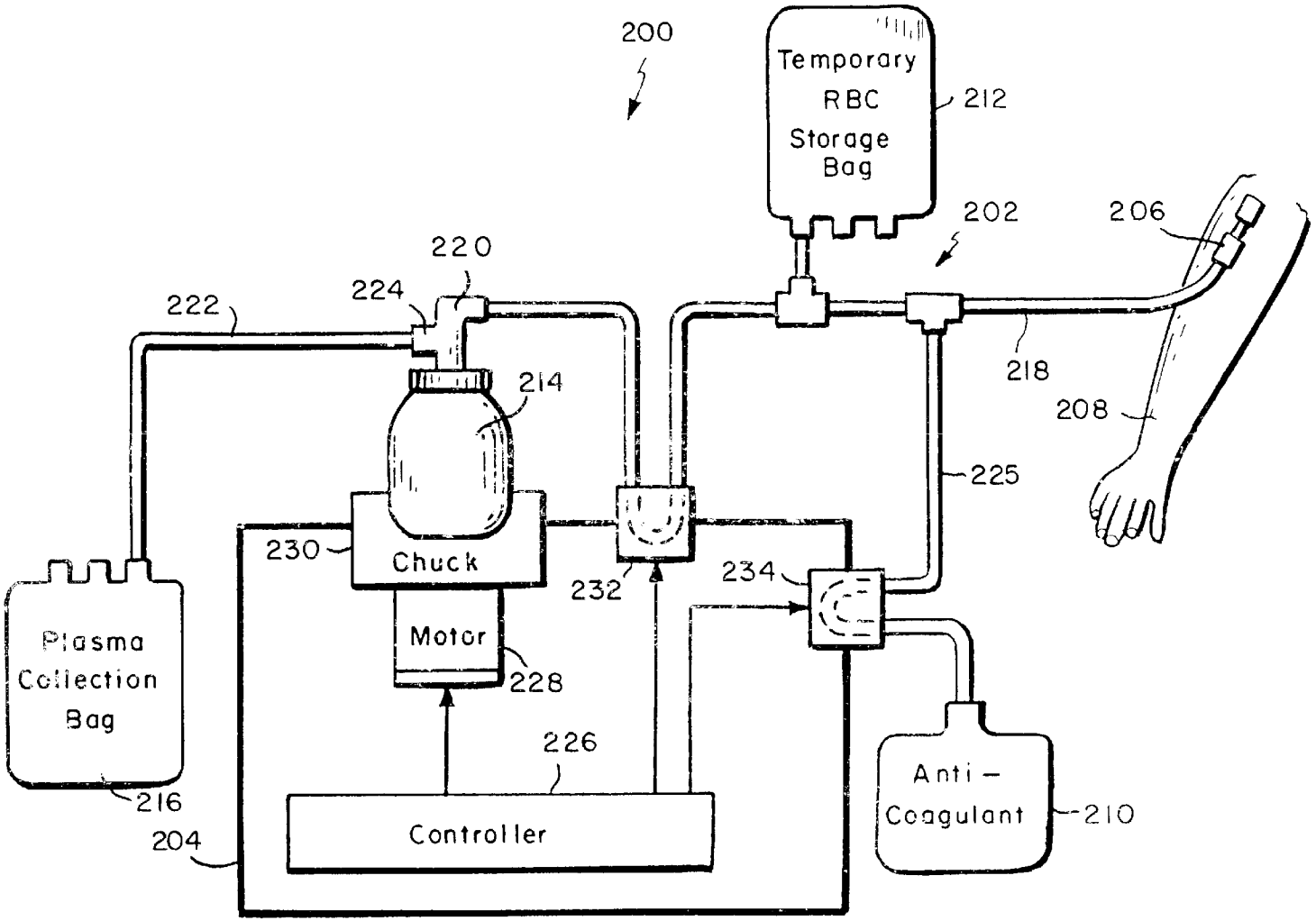
FIG. 2 is a block diagram of a plasmapheresis system in accordance with the present invention.

FIG. 2 is a schematic block diagram of a blood processing system 200 in accordance with the invention. System 200 includes a disposable collection set 202 that may be loaded onto a blood processing machine 204. The collection set 202 includes a phlebotomy needle 206 for withdrawing blood from a donor's arm 208, a container of anti-coagulant 210, such as AS-3 from Haemonetics Corp., a temporary red blood cell (RBC) storage bag 212, a centrifugation bowl 214 and a final plasma collection bag 216. An inlet line 218 couples the phlebotomy needle 206 to an inlet port 220 of the bowl 214, and an outlet line 222 couples an outlet port 224 of the bowl 214 to the plasma collection bag 216. A feed line 225 connects the anti-coagulant 210 to the inlet line 218. The blood processing machine 204 includes a controller 226, a motor 228, a centrifuge chuck 230, and two peristaltic pumps 232 and 234. The controller 226 is operably coupled to the two pumps 232 and 234, and to the motor 228, which, in turn, drives the chuck 230.

A suitable blood processing machine for use with the present invention is the PCS®2 System from Haemonetics Corp., which is used to collect plasma.

Configuration of the Centrifuge Bowl of the Present Invention

Figure 3:
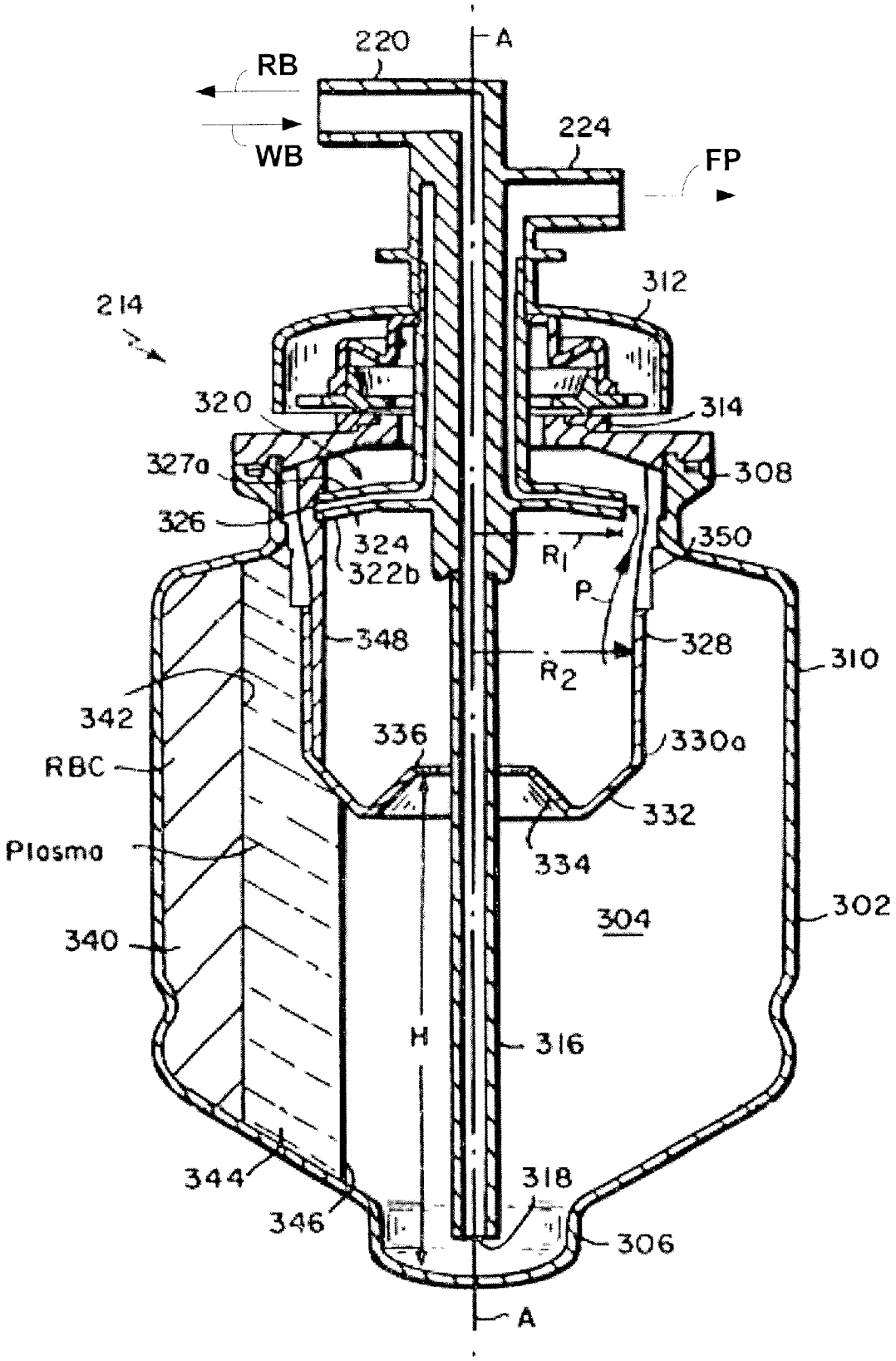
FIG. 3 is a cross-sectional side view of the centrifugation bowl of FIG. 2 illustrating the rotating filter core.

FIG. 3 is a cross-sectional side view of the centrifugation bowl 214 of the present invention. Bowl 214 includes a generally cylindrical bowl body 302 defining an enclosed separation chamber 304. The bowl body 302 includes a base 306, an open top 308 and a side wall 310. The bowl 214 further includes a header assembly 312 that is mounted to the top 308 of the bowl body 302 by a ring-shaped rotating seal 314. The inlet port 220 and outlet port 224 are part of the header assembly 312. Extending from the header assembly 312 into the separation chamber 304 is a feed tube 316 that is in fluid communication with inlet port 220. The feed tube 316 has an opening 318 that is preferably positioned proximate to the base 306 of the bowl body 302 so that liquid flowing through the feed tube 316 is discharged at the base 306 of the bowl body 302. The header assembly 312 also includes an outlet, such as an effluent tube 320, that is disposed within the separation chamber 304. The effluent tube 320 may be positioned proximate to the top 308 of the bowl body 302. In the preferred embodiment, the effluent tube 320 is formed from a pair of spaced-apart disks 322*a*, 322*b* that define a passageway 324 whose generally circumferential entryway 326 is located at a first radial position, $R_1$, relative to a central, rotating axis A—A of the bowl 214.

A suitable header assembly and bowl body for use with the present invention are described in U.S. Pat. No. 4,983,158, which is hereby incorporated by reference in its entirety. Nonetheless, it should be understood that other bowl configurations may be utilized.

Disposed within the separation chamber 304 of the bowl 302 is a filter core 328 having a generally cylindrical side wall 330. Side wall 330 is preferably disposed at a second radial position, $R_2$, that is slightly outboard of the first radial position, $R_1$, which, as described above, defines the location of the entryway 326 to the passageway 324. At a bottom 330*a* of the side wall 330 there is a first sloped section 332 that extends downward toward base 306 and is inclined toward the axis A—A. Extending upwardly from the first sloped section 332 is a solid skirt 334 that is also inclined toward the axis A—A. The skirt defines an end point 336 opposite the sloped section 332 that, in the preferred embodiment, is spaced a height, H, from the base 306 of the bowl body 302. The filter core 328 is preferably mounted for rotation with the bowl body 302. In particular, an upper portion of the filter core 328 opposite the skirt 334 may be attached to the top 308 of the bowl body 302 in a similar manner as the solid core of the '158 patent.

Both the side wall 330 and the first sloped section 332 of the filter core 328 are formed from or include a filter membrane that is sized to block one or more residual cells, such as least white blood cells, but to allow plasma to pass through. In the preferred embodiment, the filter membrane has a pore size of 2 to 0.8 microns. A suitable filter membrane for use with filter core 328 is the BTS-5 membrane from United States Filter Corp. of Palm Desert, Calif. or the Supor membrane from Pall Corp. of East Hills, N.Y. The filter membrane may be additionally or alternatively configured to block red blood cells, platelets, different types of white blood cells and/or non-cellular blood components. The skirt 334 which is solid may be formed from plastic, silicone or other suitable material. Accordingly, none of the blood components, including plasma, pass through the skirt 334 portion of the filter core 328. The skirt 334 may also be truly cylindrical and extend upwardly inside the side wall 330.

It should be understood that the filter membrane of the present invention may take multiple forms. For example, it may be formed from an affinity media to which one or more residual cells (but not plasma) adheres, thereby removing the residual cells from the plasma passing through the membrane. The filter membrane may also be formed from micro-porous membranes of equal or unequal pore size preferably in the range of 0.5 to 2.0 microns. The filter membrane may also be a combination of affinity media and micro-porous membranes. The filter core 328 may also include two or more membrane layers of varying pore size or affinity that are spaced-apart or stacked together. Preferably, the pore size of such membrane layers successively decreases toward the entryway 326 of the effluent tube 320. In addition, one or more layers of the filter membrane may be formed from a non-woven media or material.

Operation of the Present Invention

In operation, the disposable collection set 202 (FIG. 2) is loaded onto the blood processing machine 204. In particular, the inlet line 218 is routed through the first pump 232 and the feed line 225 from the anti-coagulant container 210 is routed through the second pump 234. The centrifugation bowl 214 is securely loaded into the chuck 230, with the header assembly 312 held stationary. The phlebotomy needle 206 is then inserted into the donor's arm 208. Next, the controller 226 activates the two pumps 232, 234 and the motor 228. Operation of the two pumps 232, 234, causes whole blood from the donor to be mixed with anti-coagulant from container 210 and delivered to the inlet port 220 of the bowl 214. The anti-coagulated whole blood enters the inlet port 220, as shown by arrow WB (FIG. 3), flows through the feed tube 316 (FIG. 3), and enters the separation chamber 304. Centrifugal forces generated within the separation chamber 304 of the rotating bowl 214 forces the blood against side wall 310. Continued rotation of the bowl 214 causes the blood to separate into discrete layers b density. In particular, RBCs which are the densest component of whole blood form a first layer 340 against the periphery of side wall 310. The RBC layer 340 has a surface 342. Inboard of the RBC layer 340 relative to axis A—A, a layer 344 of plasma forms, since plasma is less dense than red blood cells. The plasma layer 344 also has a surface 346.

It should be understood that a buffy coat layer (not shown) containing white blood cells and platelets may form between the layers of red blood cells and plasma.

As additional anti-coagulated whole blood is delivered to the separation chamber 304 of the bowl 214, each layer 340, 344 "grows" and thus the surface 346 of the plasma layer 344 moves toward the central axis A—A. At some point, the surface 346 will contact the cylindrical side wall 330 of the filter core 328. Due to the flow resistance of the filter membrane of side wall 330, the surface 346 of the plasma layer 344 begins to "climb" up the first sloped section 332 of the filter core 328. Indeed, the plasma will continue to climb up the sloped section 332 until a sufficient pressure head is generated to "pump" plasma through the filter element. That is, the radial "height" of the plasma layer surface 346 relative to the fixed radial position of the cylindrical side wall 330 of the filter core 328 establishes a significant pressure head due to the large centrifugal forces generated within the separation chamber 304. For example, with an outer core radius, $R_2$, of 20 mm and plasma at a radial "height" of 4 mm "above" the outer core radius, a trans-membrane pressure of approximately 300 mm of mercury (Hg) will be generated across the filter core 328, which should be more than sufficient to pump plasma through the filter membrane. The height differences shown in the figures have been exaggerated for illustrative purposes. In addition, the radial "depth" of the filter core 328 is preferably sized to prevent unfiltered plasma from spilling over the endpoint 336 of the skirt 334 and being extracted from the bowl 214. That is, endpoint 336, as defined by the radial extent of first sloped section 332 and skirt 334, is positioned closer to axis A—A than the plasma surface 346 during anticipated operating conditions of the bowl 214.

Due to the configuration of the filter membrane (e.g., pore size) at side wall 330 and sloped section 332, only plasma is allowed to pass through filter core 328. Any residual blood components, such as white blood cells, still within the plasma layer 344 are trapped on the outer surface of the filter 328 core relative to axis A—A. After passing through the filter core 328, filtered plasma 348 enters the entryway 326 of the effluent tube 320 as shown by arrow P (FIG. 3) and flows along the passageway 326. From here, the filtered plasma is removed from the bowl 214 through the outlet port which is in fluid communication with the effluent tube 320, as shown by arrow FP (FIG. 3). The filtered plasma is then transported through the outlet line 222 (FIG. 2) and into the plasma collection bag 216.

As additional anti-coagulated whole blood is delivered to the bowl 214 and filtered plasma removed, the depth of the RBC layer 340 will grow. When the surface 342 of the RBC layer 340 reaches the filter core 328, indicating that all of the plasma in the separation chamber 304 has been removed, the process is preferably suspended. The fact that the surface 342 of the RBC layer 340 has reached the filter core 328 may be optically detected. In particular, the bowl 214 may further include a conventional optical reflector 350 that is spaced approximately the same distance (e.g., $R_2$) from the central axis A—A as the side wall 330 of the filter core 328. The reflector 350 cooperates with an optical emitter and detector (not shown) located in the blood processing machine 204 to sense the presence of RBCs at a preselected point relative to the filter core 328 causing a corresponding signal to be sent to the controller 226. In response, the controller 226 suspends the process.

It should be understood that the optical components and the controller 226 may be configured to suspend bowl filling at alternative conditions and/or upon detection of other fractions.

Specifically, the controller 226 de-activates the pumps 232, 234 and the motor 228, thereby stopping the bowl 214. Without the centrifugal forces, the RBCs in layer 340 drop to the bottom of the bowl 214. That is, the RBCs settle to the bottom of the separation chamber 304 opposite the header assembly 312. As mentioned above, the end point 336 of the skirt 334 is preferably positioned so that the RBCs contained within the now stopped bowl 214 do not spill over and contact the inside surface of the filter membrane relative to axis A—A. For example, the height, H, of the end point 336 relative to the base 306 of the bowl body 302 is greater than the height of the RBCs when the bowl 214 is stopped. Thus, the RBCs do not contact any inner surface portion of the filter core 328. The significance of this feature is described in greater detail below.

After waiting a sufficient time for the RBCs to settle in the stopped bowl 214, the controller 226 activates pump 232 in the reverse direction. This causes the RBCs in the lower portion of the bowl 214 to be drawn up the feed tube 316 and out of the bowl 214 through the inlet port 220, as shown by arrow RB (FIG. 3). The RBCs are then transported through the inlet line 218 and into the temporary RBC storage bag 212. It should be understood that one or more valves (not shown) may be operated to ensure that the RBCs are transported to bag 212. To facilitate the evacuation of RBCs from the bowl 214, the configuration of skirt 334 preferably allows air from plasma collection bag 216 to easily enter the separation chamber 304. That is, the end point 336 of the skirt 334 is spaced from the feed tube 316 and the skirt 334 does not otherwise block the flow of air from the effluent tube 320 to the separation chamber 304. Accordingly, air need not cross the wet filer core 328 in order to allow RBCs to be evacuated. It should be understood that this configuration and arrangement also facilitates air removal from the separation chamber 304 during bowl filling.

When all of the RBCs from bowl 214 have been moved to the temporary storage bag 212, the system 200 is ready to begin the next plasma collection cycle. In particular, controller 226 again activates the two pumps 232, 234 and the motor 228. In order to "clean" the filter core 228 prior to the next collection cycle, the controller 226 preferably activates the motor 228 and the pumps 232, 234 in such a manner (or in such a sequence) as to rotate the bowl 214, at its operating speed, for some period of time before anti-coagulated whole blood is allowed to reach the separation chamber 304. By rotating the filter core 228 in the empty bowl 214, residual blood cells that were "trapped" on its outer surface during the plasma collection process are flung off. Thus, the filter core 228 is effectively "cleaned" of residual blood cells that might be adhered to its surface. This intermediary "cleaning" step ensures that the entire surface area of the filter membrane is available for filtering during each plasma collection cycle and not just the first collection cycle.

With the filter cleaned of trapped cells, the plasma collection process proceeds as described above. In particular, anti-coagulated whole blood separates into its constituent components within the separation chamber 304 of the bowl 214 and plasma is pumped through the filter core 328. Filtered plasma is removed from the bowl 214 and transported along the outlet line 222 to the plasma collection bag 216 adding to the plasma collected during the first cycle. When the separation chamber 304 of the bowl 214 is again full of RBCs (as sensed by the optical detector), the controller 226 stops the collection process. Specifically, the controller deactivates the two pumps 232, 234 and the motor 228. If the process is complete (i.e., the desired amount of plasma has been donated), then the system returns the RBCs to the donor. In particular, controller 226 activates pump 232 in the reverse direction to pump RBCs from the bowl 214 and from the temporary storage bag 212 through the inlet line 218. The RBCs flow through the phlebotomy needle 206 and are thus returned to the donor.

After the RBCs have been returned to the donor, the phlebotomy needle 206 may be removed and the donor released. The plasma collection bag 216, which is now full of filtered plasma, may be severed from the disposable collection set 202 and sealed. The remaining portions of the disposable set 202, including the needle, bags 210, 212 and bowl 214 may be discarded. The filtered plasma may be shipped to a blood bank or hospital.

The significance of preventing any residual cells or non-plasma blood components from contacting the inside surface of the filter core 328 relative to axis A—A should now be appreciated. In particular, residual cells allowed to contact the inside surface of the filter core 328 would not be removed by rotating the bowl 214 while it is empty. Instead, these residual cells would simply remain stuck on the inside surface of the filter core 328. When the collection process is resumed, moreover, these residual cells would be pulled through the effluent tube 320 along with the plasma, thereby "contaminating" the filtered plasma in the collection bag 216. Accordingly, in the preferred embodiment, the filter core is configured so that non-plasma blood components are precluded from contacting the filter core's inner surface.

Furthermore, depending on the desired surface area of the filter membrane and the anticipated height of red blood cells in the stopped bowl, it may be possible to omit the skirt 332. That is, if sufficient filtration area can be achieved with the lowest extremity of the filter core still above the RBCs occupying the stopped bowl 214, then skirt 332 may be omitted. In the preferred embodiment, filter core 328 has a filtration area of approximately 50 $cm^2$. Additionally, those skilled in the art will recognize that, if only a single collection cycle is performed, residual cells could be permitted to contact the filter core's inner surface. More specifically, residual cells (such as the contents of the stopped bowl) could be allowed to contact the filter core's inner surface during evacuation of red blood cells.

As shown, the present invention provides an efficient, low-cost system for collecting a filtered or "purer" plasma product than currently possible with conventional centrifugation bowls. In the preferred embodiment, the system 200 further includes one or more means for detecting whether the filter core 328 has become clogged. In particular, the blood processing machine 204 may include one or more conventional fluid flow sensors (not shown) coupled to the controller 226 to measure flow of anti-coagulated whole blood into the bowl 214 and the flow of filtered plasma out of the bowl 214. Controller 226 preferable monitors the outputs of the flow sensors and if the flow of whole blood exceeds the flow of plasma for an extended period of time, the controller 226 preferably suspends the collection process. The system 200 may further include one or more conventional line sensors (not shown) that detect the presence of red blood cells in the outlet line 222. The presence of red blood cells in the outlet line 222 may indicate that the blood components in the separation chamber 304 have spilled over the skirt 334.

Figure 4:
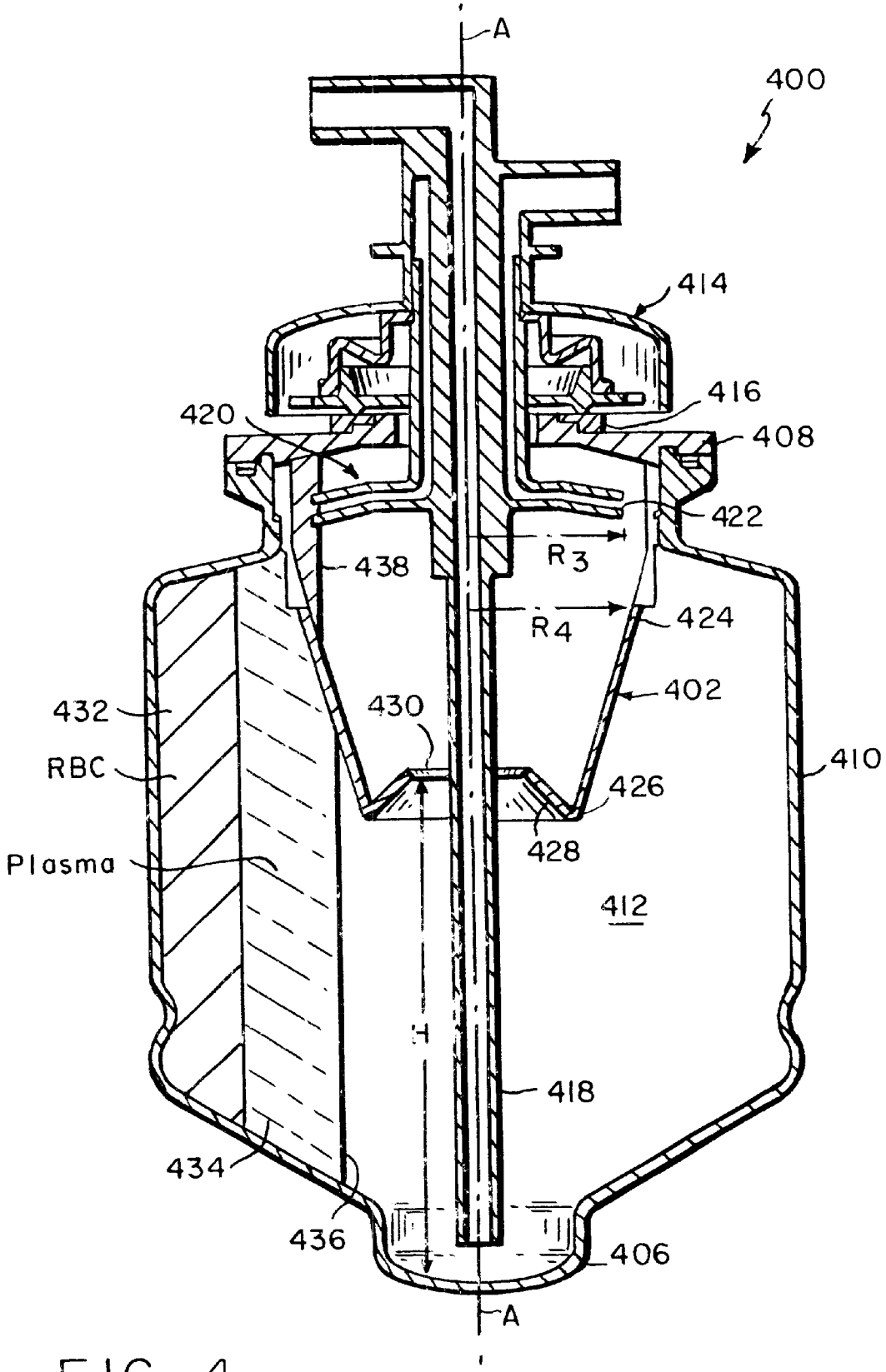
FIG. 4 is a cross-sectional side view of an alternative embodiment of the centrifugation bowl of the present invention.

It should be understood that the filter core may have alternative configurations. FIG. 4, for example, is a cross-sectional side view a centrifugation bowl 400 having a generally truncated-cone shaped filter core 402. Bowl 400 includes many similar elements to bowl 214. For example, bowl 400 has a generally cylindrical bowl body 404 having a base 406, an open top 408 and a side wall 410, for defining an enclosed separation chamber 412. A header assembly 414 is mounted to the bowl body 402 via a rotating seal 416. A feed tube 418 extends into the separation chamber 412 of the bowl 400, and the header assembly 414 includes an effluent tube 420 defining an entryway 422. The truncated-cone shaped filter core 402, which includes a large diameter section 424 and a small diameter section 426, also extends into the separation chamber 412. In particular, the large diameter section 424 of the filter core 402 is preferably disposed at a radial position, $R_3$, that is slightly outboard of a radial position, $R_4$, of the entryway 422 of the effluent tube 420. A solid skirt 428 is preferably formed at the small diameter section 424 of the filer core 402. Skirt 428 preferably extends upwardly relative to the header assembly 414 and may be sloped toward the central axis of rotation A—A. Skirt 428 similarly defines an end point 430 that, in the preferred embodiment, is spaced a height, H, from the base 406 of the bowl body 404, for the reasons described above. The filter core 402, not including the skirt 428, is preferably formed from a filter membrane that is sized to block at least white blood cells, but to allow plasma to pass through.

In operation, anti-coagulated whole blood is similarly delivered to the separation chamber 412 of the rotating bowl 400. The whole blood separates into an RBC layer 432 and a plasma layer 434 having a surface 436. Due to the flow resistance presented by the filter membrane of filter core 402, the surface 436 of the plasma layer 434 "climbs" up a portion of the truncated cone-shaped filter core 402 until a sufficient pressure head is generated to "pump" plasma through the membrane, creating a filtered plasma 438. Furthermore, by spacing the end point 430 of the skirt 428 a height H from the base 406 of the bowl body 404, residual cells including RBCs are prevented from contacting the inner surface of the filter core 402 while the bowl 400 is stopped.

Figure 5:
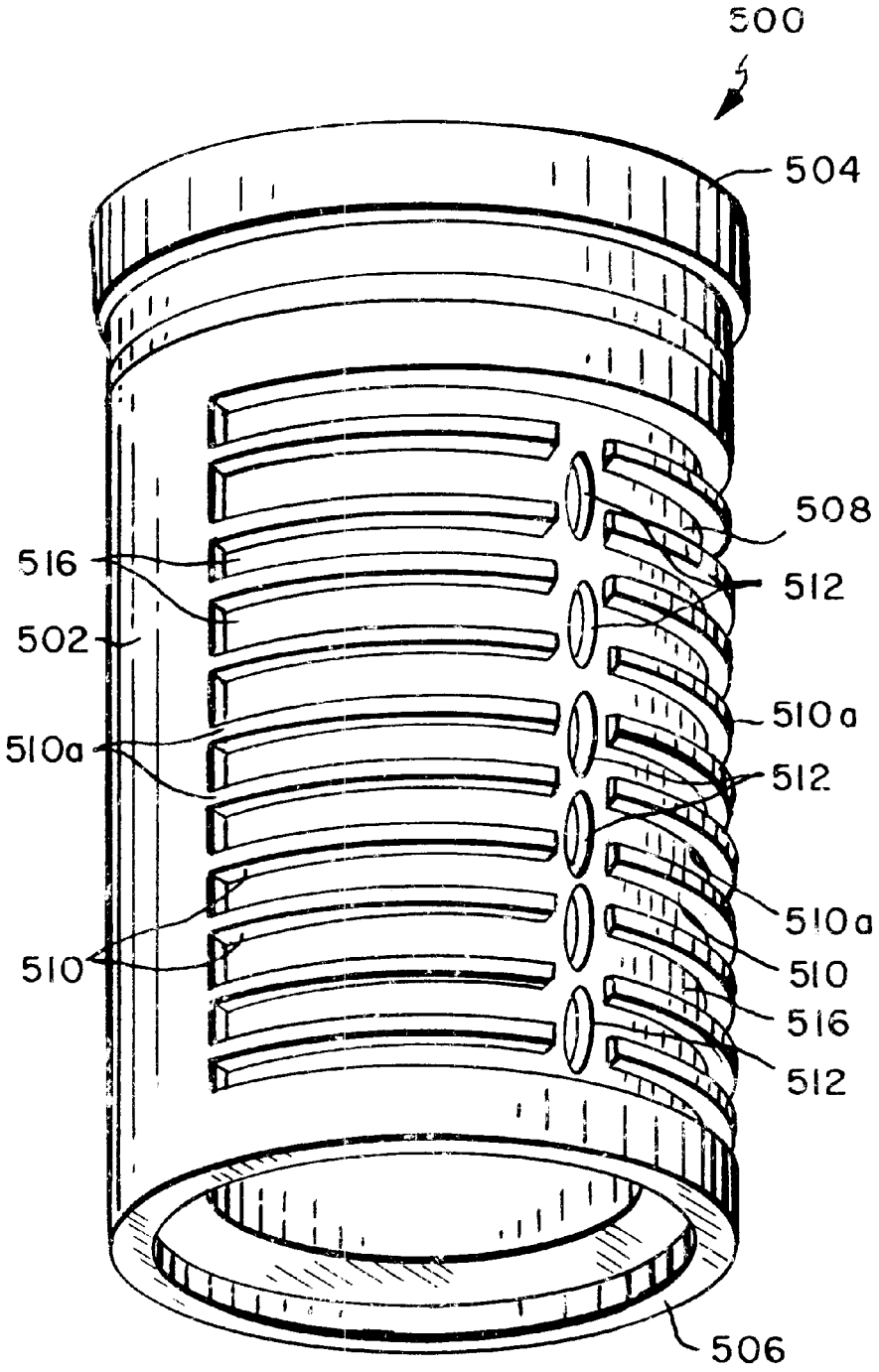
FIG. 5 is an isometric view of a preferred support structure for the filter core of the present invention.
Figure 6:
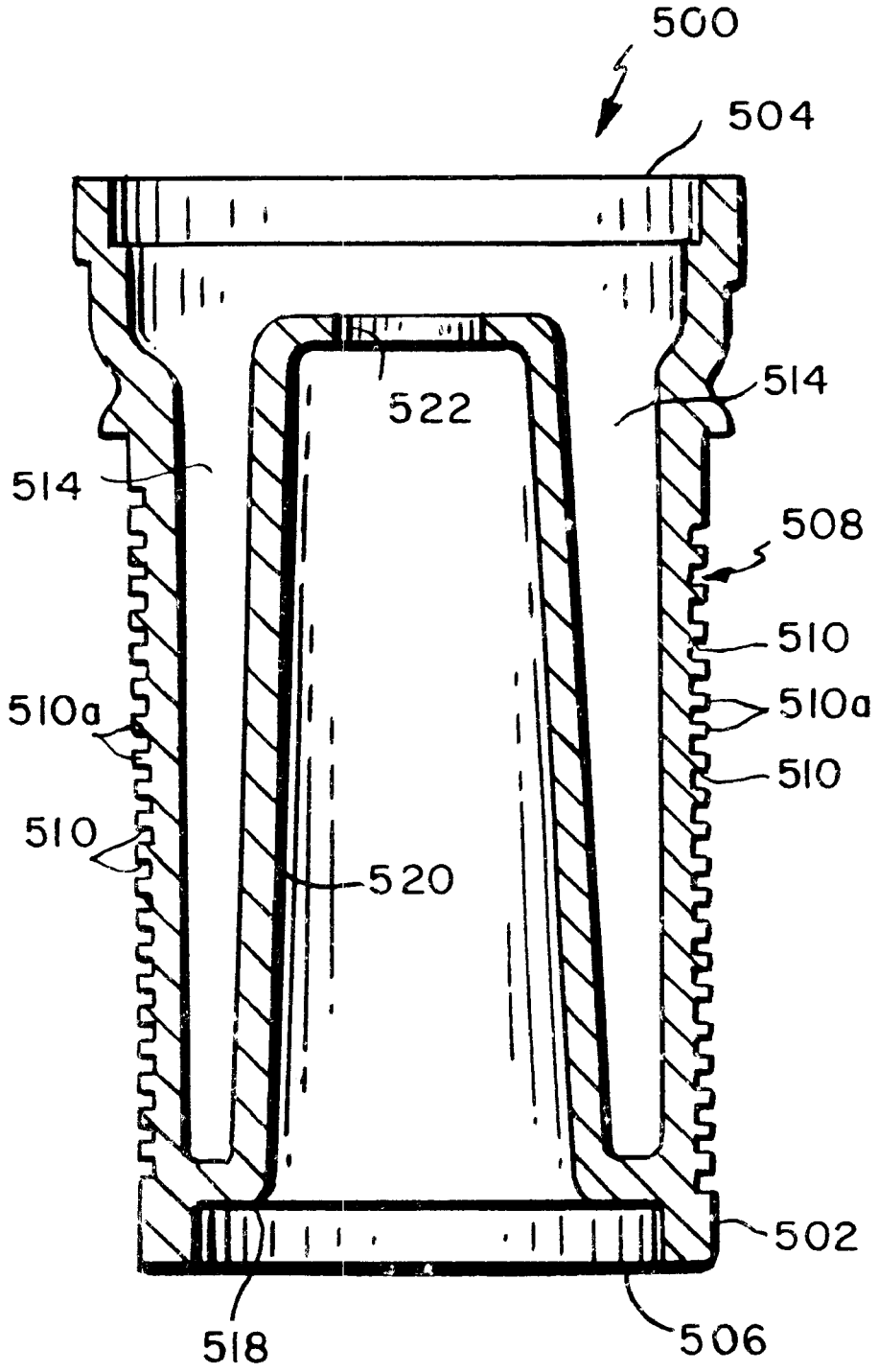
FIG. 6 is a cross-sectional side view of the support structure of FIG. 5.

FIGS. 5 and 6 are an isometric and a cross-sectional side view, respectively, of a preferred filter core support structure 500. The support structure 500 has a generally cylindrical shape defining an outer cylindrical surface 502, a first open end 504 and a second open end 506. Formed in the outer surface 502 of the support structure 500 are one or more underdrain regions, such as underdrain region 508, which preferably encompass a substantial portion of the surface area of the support structure 500. In the preferred embodiment, each underdrain region 508 is recessed relative to outer surface 502. Disposed within each underdrain region 508 are a plurality of spaced-apart ribs 510, each including a top surface 510*a* that is flush with the outer surface 502 of the support structure 500. Each underdrain region 508 also includes a plurality of drain holes 512 (FIG. 5) that provide fluid communication to the interior 514 (FIG. 6) of the support structure 500. More specifically, the spaces between adjacent ribs 510 define corresponding channels 516 that lead to the drain holes 512.

In place of sloped section 332 (FIG. 3) of filter core 328, support structure 500 includes an inwardly extending shelf 518 (FIG. 6) that is disposed at second open end 506. Support structure 500 also includes a skirt 520 that is similar to skirt 334 (FIG. 3). In particular, skirt 520, which has a truncated cone shape, is attached to shelf 518 and extends from second open end 506 toward first open end 504 within the interior 514 of support structure 500. Skirt 520 also defines an opening 522 opposite second open end 506 that provides fluid communication between first and second ends 504, 506.

Wrapped around the support structure 500 is a filter medium (not shown) configured to block one or more residual cells but to allow plasma to pass through. The filter medium may be attached to the support structure 500 by any suitable means, such as tape, ultrasonic welding, heat seal, etc. Due to the configuration of ribs 510, the filter medium is spaced from the respective underdrain region 508. That is, in the area of the underdrain region 508, the filter medium is supported by the top surfaces 510*a* or ribs 510. As plasma passes through the filter medium it enters the corresponding underdrain region 508. From here, the filtered plasma flows along the channels 516, through drain holes 512 and into the interior 514 of the support structure. Support structure 500 is preferably mounted to the bowl body 302 (FIG. 3) such that first open end 504 is proximate to header assembly 312. As described above, filtered plasma is extracted from the bowl 214 (FIG. 3) by the outlet 520 (FIG. 3). Furthermore, the configuration of skirt 520 prevents unfiltered plasma either from being extracted from the bowl 214 or from contacting the inner surface of the filter medium. Additionally, the opening 522 is the skirt 520 allows the feed tube 316 (FIG. 3) to extend through the support structure 500 and allows air to enter the separation chamber 304 of the bowl 214 during removing of red blood cells or other components.

Those skilled in the art will understand that other configurations of the filter core, including the support structure, are possible provided that the plasma is forced to pass through the filter core before reaching the outlet.

It should be further understood that the filter core of the present invention may be stationary relative to the rotatable bowl body. That is, the filter core may alternatively be affixed to the header assembly rather than to the bowl body. It should also be understood that the filter core of the present invention may be incorporated into centrifugation bowls having different geometries, including the bell-shaped Latham series of centrifugation bowls from Haemonetics Corp.

The foregoing description has been directed to specific embodiments of this invention. It will be apparent, however, that other variations and modifications may be made to the described embodiments with the attainment of some or all of their advantages. Accordingly, this description should be taken only by way of example and not by way of limitation. For example, the filter membrane may actually be inboard of the entryway of the effluent tube provided that some structure conveys the filtered plasma back out to the entryway. It is the object of the appended claims to cover all such variations and modifications as come within the true spirit and scope of the invention.

What is claimed is:

1. A method for collecting a plasma fraction from whole blood, the method comprising the steps of providing a rotary centrifugation bowl having a rotary axis and a tubular core with a permeable side wall surrounding said axis, said bowl also having a bottom wall and a side wall spaced radially from the core side wall;

delivering whole blood via a conduit into the bowl;

rotating the bowl about said axis at a speed such that the plasma fraction of the whole blood becomes separated from other more dense components of the whole blood due to centrifugal force and is forced under pressure from the other blood components through the core side wall into the interior of the core while the other blood components remain outside the core;

conducting the plasma fraction from the interior of the core while the bowl is rotating;

stopping the delivery of whole blood into the bowl and the rotation of the bowl so that the other blood components settle to the bottom of the bowl, and removing the other blood components from the bottom of the bowl.

2. The method defined in claim 1 wherein the other blood components are removed from the bottom of the bowl via the same conduit that delivered whole blood into the bowl.

3. The method defined in claim 1 including initiating the stopping step when the radial accumulation of the other blood components outside the core approaches the core side wall.

4. The method defined in claim 1 including the step of, after the removing step, rotating the bowl about said axis to fling away any of said other blood components adhering to the core side wall.

5. The method defined in claim 1 wherein said core wall has an interior surface and including the additional step of preventing the other blood components that settle to the bottom of the stopped bowl from contacting the interior surface of the core side wall.

6. The method defined in claim 5 wherein the preventing step is accomplish by dimensioning the bowl and/or the core so that the level of the other blood components that settle to the bottom of the stopped bowl remains below the core side wall.

7. The method defined in claim 5 wherein the preventing step is accomplished by forming the core with a bottom opening and an impermeable re-entrant wall that surrounds said bottom opening and extends within the core.

8. Blood processing apparatus for collecting a plasma fraction from whole blood, said apparatus comprising a header;

a centrifugation bowl rotatable relative to the header about an axis, said bowl having a side wall radially spaced from said axis and a bottom wall;

a tubular core within said bowl and fixed to rotate therewith, said core having a permeable side wall spaced opposite the side wall of the bowl and an open bottom spaced from the bottom wall of the bowl;

a fluid inlet passing through the header into the interior of said core, said inlet extending beyond the bottom of the core toward the bottom wall of the bowl;

a fluid outlet extending from the interior of the core through the header.

9. The apparatus defined in claim 8 wherein the inlet extends along said axis to a location relatively close to the bottom wall of the bowl.

10. The apparatus defined in claim 9 wherein the bowl is deeper at said axis than at the side wall of the bowl.

11. The apparatus defined in claim 8 wherein the core includes an annular impermeable bottom wall having a central opening that receives said inlet.

12. The apparatus defined in claim 11 wherein said bottom wall of the core includes an annular re-entrant portion which surrounds said axis and extends within the core.

13. Apparatus for processing blood to separate and collect a selected lower density component thereof from other higher density components of the blood, said apparatus comprising a centrifugation bowl configured for engagement by a rotary chuck and adapted for rotation about an axis, said bowl having a side wall spaced radially from the axis and a closed bottom;

a tubular core having a permeable side wall surrounding said axis within the bowl and fixed to rotate with the bowl, said core wall being spaced opposite the side wall of the bowl and having an interior surface;

a means for delivering blood into the bowl without contacting the interior surface of the core and for removing any of said other blood components that settle to the bottom of the bowl; and a fluid outlet for conducting the selected blood component from the interior of the core out the bowl.

14. The apparatus defined in claim 13 wherein the side wall of the core comprises a filter membrane.

15. The apparatus defined in claim 14 wherein said filter membrane is formed at least in part from a medium having an affinity for one or more types of said other blood components.

16. The apparatus defined in claim 14 wherein the filter membrane contains two or more layers.

17. The apparatus defined in claim 13 wherein the core side wall has pores whose size is in the range of 0.5 to 2.0 microns.

18. Apparatus for processing blood to separate and collect a selected lower density component thereof from other higher density components of the blood, said apparatus comprising a centrifugation bowl configured for engagement by a rotary chuck and adapted for rotation about an axis, said bowl having a side wall spaced radially from the axis and a closed bottom;

a tubular core having a permeable wall surrounding said axis within the bowl and fixed to rotate with the bowl, said core wall being spaced opposite the side wall of the bowl and having an interior surface;

a fluid inlet for delivering blood into the bowl without contacting the interior surface of the core, the fluid inlet extending along said axis to the bottom of the core, the fluid inlet including conduit means for removing any of said other blood components that settle to the bottom of the bowl, said conduit means constituting an extension of the fluid inlet, said extension extending to a location relatively close to the bottom of the bowl; and a fluid outlet for conducting the selected blood component from the interior of the core out the bowl.

19. Apparatus for processing blood to separate and collect a selected lower density component thereof from other higher density components of the blood, said apparatus comprising a centrifugation bowl configured for engagement by a rotary chuck and adapted for rotation about an axis, said bowl having a side wall spaced radially from the axis and a closed bottom;

a tubular core having a permeable wall surrounding said axis within the bowl and fixed to rotate with the bowl, said core wall being spaced opposite the side wall of the bowl and having an interior surface, a bottom opening and an impermeable re-entrant wall which surrounds said bottom opening and extends within said core;

a means for delivering blood into the bowl without contacting the interior surface of the core and for removing any of said other blood components that settle to the bottom of the bowl; and a fluid outlet for conducting the selected blood component from the interior of the core out the bowl.

20. Apparatus for processing blood to separate and collect a selected lower density component thereof from other higher density components of the blood, said apparatus comprising a centrifugation bowl configured for engagement by a rotary chuck and adapted for rotation about an axis, said bowl having a side wall spaced radially from the axis and a closed bottom;

a tubular core having a permeable side wall surrounding said axis within the bowl and fixed to rotate with the bowl, said core wall being spaced opposite the side wall of the bowl and having an interior surface, the core side wall including a filter membrane containing two or more layers, each membrane layer having a pore size, the pore sizes of the layers progressively decreasing toward said axis;

a means for delivering blood into the bowl without contacting the interior surface of the core and for removing any of said other blood components that settle to the bottom of the bowl; and a fluid outlet for conducting the selected blood component from the interior of the core out the bowl.

21. Apparatus for processing blood to separate and collect a selected lower density component thereof from other higher density components of the blood, said apparatus comprising a centrifugation bowl configured for engagement by a rotary chuck and adapted for rotation about an axis, said bowl having a side wall spaced radially from the axis and a closed bottom;

a tubular core having a permeable side wall surrounding said axis within the bowl and fixed to rotate with the bowl, said core wall being spaced opposite the side wall of the bowl and having an interior surface, the core side wall comprising a relatively rigid cylinder having flow channels therethrough and a sleeve-like filter medium encircling the cylinder;

a means for delivering blood into the bowl without contacting the interior surface of the core and for removing any of said other blood components that settle to the bottom of the bowl; and a fluid outlet for conducting the selected blood component from the interior of the core out the bowl.

22. The apparatus defined in claim 21 wherein the cylinder has a bottom opening and an impermeable re-entrant wall surrounding said bottom opening and extending within the cylinder.

* * * * *